US007382250B2

(12) United States Patent
Marcelle et al.

(10) Patent No.: US 7,382,250 B2
(45) Date of Patent: Jun. 3, 2008

(54) LOCK SYSTEM WITH REMOTE CONTROL SECURITY DEVICE

(75) Inventors: Jesse Marcelle, Franklin, WI (US); Glenn Meekma, Menomonee Falls, WI (US); Vince Leslie, Glendale, WI (US)

(73) Assignee: Master Lock Company LLC, Oak Creek, WI (US)

( * ) Notice: Subject to any disclaimer, the term of this patent is extended or adjusted under 35 U.S.C. 154(b) by 140 days.

(21) Appl. No.: 10/906,945

(22) Filed: Mar. 14, 2005

(65) Prior Publication Data

US 2005/0199019 A1 Sep. 15, 2005

Related U.S. Application Data

(60) Provisional application No. 60/521,212, filed on Mar. 12, 2004.

(51) Int. Cl.
*E05B 45/06* (2006.01)

(52) U.S. Cl. ..... 340/542; 340/541; 340/5.22; 340/5.54; 340/5.61; 340/5.64; 340/5.73; 340/825.69; 700/277; 700/278; 700/281; 700/283

(58) Field of Classification Search ..... 340/541, 340/542, 5.1, 5.22, 5.61, 5.64, 5.73, 426.1, 340/427, 432, 5.54, 825.69; 70/277, 278, 70/281, 283, 38
See application file for complete search history.

(56) References Cited

U.S. PATENT DOCUMENTS 4,808,993 A * 2/1989 Clark ..... 340/5.65
4,885,572 A 12/1989 Iwata et al.
5,280,518 A * 1/1994 Danler et al. ..... 379/102.06
5,404,735 A 4/1995 Hsieh
5,408,212 A * 4/1995 Meyers et al. ..... 340/427
5,534,847 A 7/1996 McGregor
5,546,776 A 8/1996 Sun et al.
5,550,529 A * 8/1996 Burge ..... 340/5.6
5,552,777 A * 9/1996 Gokcebay et al. ..... 340/5.54
5,587,702 A 12/1996 Chadfield
5,727,405 A 3/1998 Cromwell
5,764,135 A 6/1998 Warren
6,046,558 A * 4/2000 Larson et al. ..... 318/283

(Continued)

FOREIGN PATENT DOCUMENTS

DE 9202927 9/1992

(Continued)

OTHER PUBLICATIONS

International Search Report from PCT/US2005/008396.

(Continued)

*Primary Examiner*—Hung T. Nguyen
(74) *Attorney, Agent, or Firm*—Calfee, Halter & Griswold LLP

(57) ABSTRACT

A lock includes two independently operating locking mechanism, one locking mechanism operating electronically and one locking mechanism operating mechanically. The lock may include a device for receiving and decoding an electronic unlock signal and a memory source for storing multiple unique unlock signals. The electronic signal may be generated from a remote source or on the lock itself. The lock also may include a button that allows unique unlock signals to be added or deleted from the lock memory.

35 Claims, 15 Drawing Sheets

U.S. PATENT DOCUMENTS

| | | | |
|---|---|---|---|
| 6,060,982 | A | 5/2000 | Holtrop |
| 6,236,307 | B1 | 5/2001 | Kurano |
| 6,337,618 | B1 | 1/2002 | Craig et al. |
| 6,531,954 | B1 | 3/2003 | Kim |
| 6,761,051 | B1 | 7/2004 | Tsai |
| 2003/0107479 | A1 | 6/2003 | Evans |
| 2003/0179075 | A1* | 9/2003 | Greenman |

FOREIGN PATENT DOCUMENTS

| | | |
|---|---|---|
| DE | 10114544 | 10/2002 |
| EP | 1205885 | 5/2002 |
| WO | WO 00/61897 | 10/2000 |

OTHER PUBLICATIONS

International Search Report from PCT/US2005/008396, Jun. 30, 2005.

* cited by examiner

LOCK SYSTEM WITH REMOTE CONTROL SECURITY DEVICE

CROSS-REFERENCE TO RELATED PATENT APPLICATIONS

This application claims the benefit of U.S. Provisional Patent Application No. 60/521,212 filed on Mar. 12, 2004, the entire disclosure of which is hereby incorporated by reference.

FIELD OF THE INVENTION

The present invention is directed to an improved lock, and more specifically to a lock including an electronically operated locking mechanism and a mechanically operated locking mechanism that operate independently of one another.

BACKGROUND

Security devices, such as locks, are used in a variety of ways to secure a variety of objects. When securing objects, it is not always convenient to carry a key or remember a combination. This is especially true for users with multiple locks, each having a different key or combination. Additionally, it can be more convenient to unlock the lock from a given distance away from the lock and without having to mechanically manipulate a portion of the lock. Furthermore, since the user of the lock is not always in the presence of the object to be secured by the lock, the user frequently does not know that the lock is being tampered with until it is too late and the object is gone.

SUMMARY OF THE INVENTION

A lock including two independently operating locking mechanism, one locking mechanism operating electronically and one locking mechanism operating mechanically is provided. In one embodiment, the lock includes a device for receiving and decoding an electronic unlock signal and a memory source for storing multiple unique unlock signals. In some embodiments, the lock receives an unlock signal from a key fob or other remote device, while in other embodiments that lock receives an unlock signal directly from interaction with the user. In some embodiments, the lock may include a button that allows unique unlock signals to be added or deleted from the lock memory.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to illustrate the principles of this invention.

DESCRIPTION OF THE INVENTION

Figure 2:
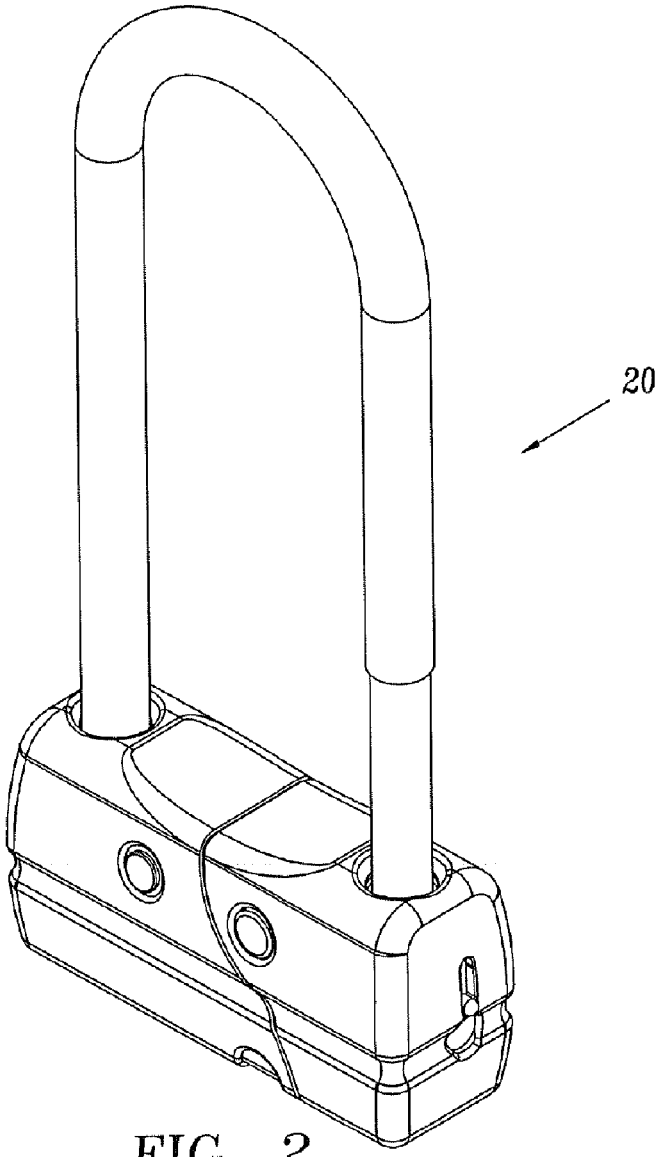
FIG. 2 illustrates an exemplary embodiment of a lock of the present invention.
Figure 3:
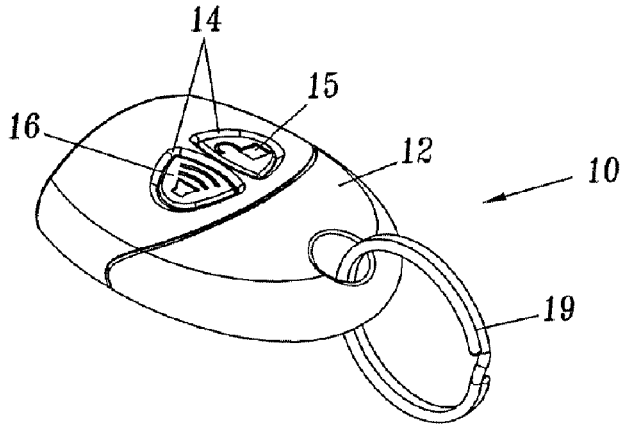
FIG. 3 is a illustrates an exemplary embodiment of a key fob of the present invention.
Figure 6:
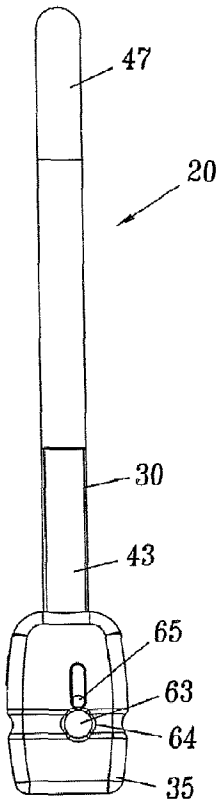
FIG. 6 is a side view of the lock shown in FIG. 2.
Figure 5:
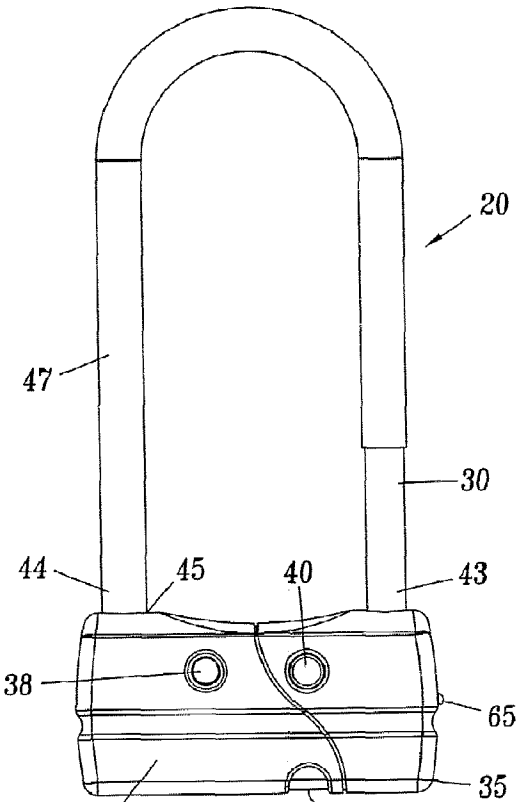
FIG. 5 is a front view of the lock shown in FIG. 2.
Figure 7:
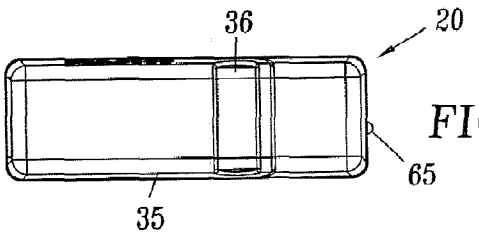
FIG. 7 is a bottom view of the lock shown in FIG. 2.
Figure 4:
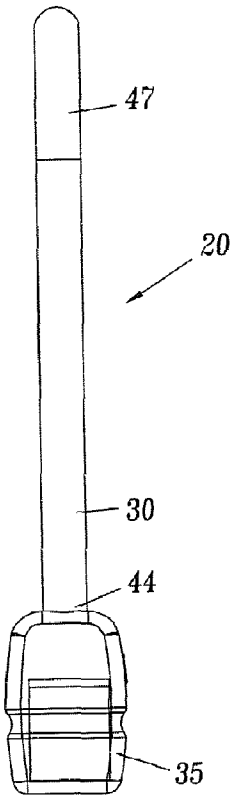
FIG. 4 is a side view of the lock shown in FIG. 2.
Figure 10:
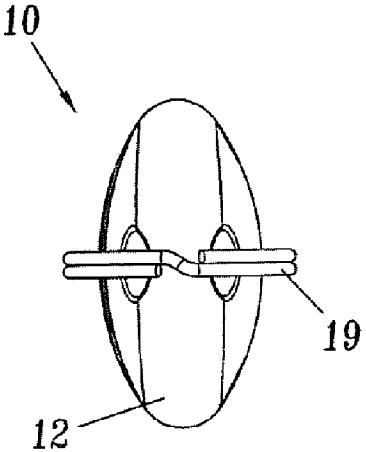
FIG. 10 is a back view of the key fob shown in FIG. 3.
Figure 9:
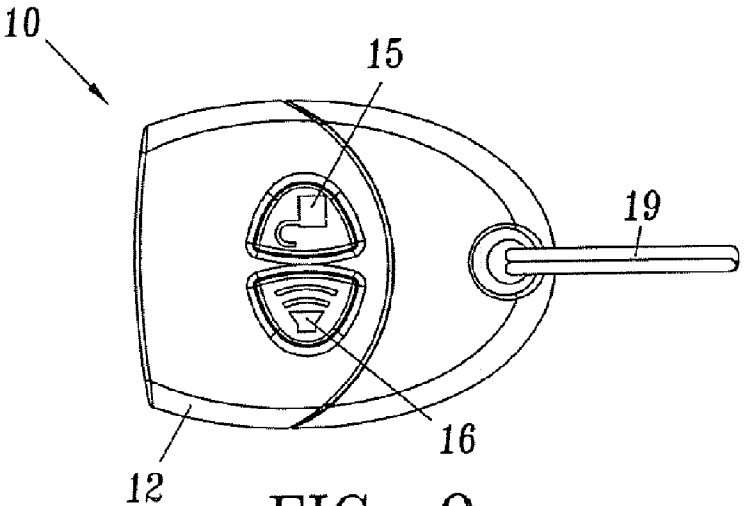
FIG. 9 is a top view of the key fob shown in FIG. 3.
Figure 11:
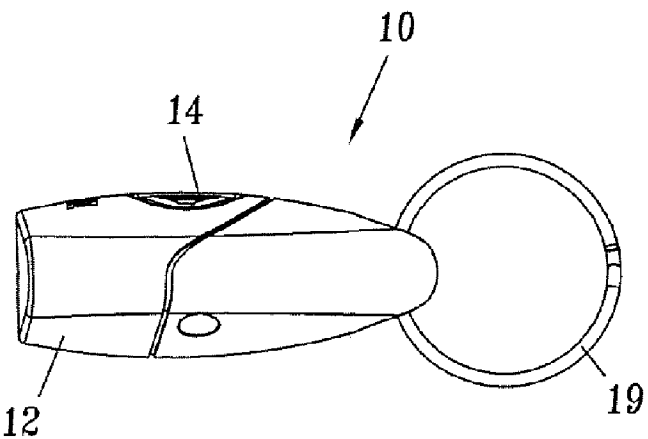
FIG. 11 is a side view of the key fob shown in FIG. 3.
Figure 8:
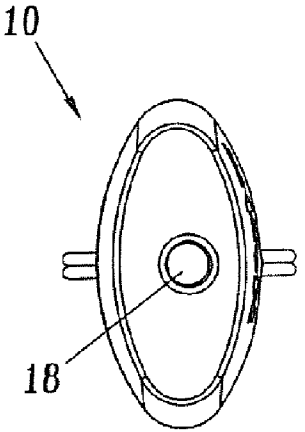
FIG. 8 is a front view of the key fob shown in FIG. 3.

FIGS. 2 and 3 illustrate an example of a security device that can be unlocked or disarmed from a distance. This example includes a lock and a corresponding key fob that is used to active the lock. The security device can be used with a remote key fob that uses infrared, radio frequency, RFID or the like, or a remote signal from, for example, a PDA, computer, cell phone or the like, to transmit a message to the lock that will allow the user to unlock the lock from a distance away from the lock. The distance in which the security device can be unlocked from is dependent on the technology implemented. For example, most direct source devices would have a range of 1 to 15 meters, however use of other technology, such as, for example, the Internet, satellite communication or other such systems could be used to extend the distance. The security device offers convenience to the user, because they do not have to insert a key blade or dial or remember a combination. This embodiment can also have an optional alarm that can be controlled (on/off) with the remote key fob. This alarm can be triggered by any alarm type device, such as, for example, a motion sensor. In addition, an optional mechanical key over-ride can be used to unlock the security device. The details of this embodiment is described in further detail below. One skilled in the art should recognize that the embodiment shown in FIGS. 2 and 3 are merely illustrative and, as such, can be varied or modified in many different ways. Such modifications are contemplated by this invention and consequently are intended to be covered within the scope of this application.

The key fob 10 as shown in the FIGS. 3, 8-11 and 13 generally includes a housing 12, one or more activation buttons 14, and an Infrared (IR) LED 18 for relaying a message to the lock 20. The activation buttons 14 shown in the Figures include an unlock button 15 and an alarm button 16. However one skilled in the art should recognize that the actuation buttons 14 are tied to the desired functionality of the key fob 10 and can therefore be provided in any number or any shape or size. For example, in other embodiments, the key fob is replaced by a cellular phone, PDA or other electronic device. The actuation buttons 14 may be incorporated into already existing keys or buttons, such as the number buttons on a phone, or can be added as separately functioning buttons. The key fob 10 may optionally include a key ring 19 or other attachment mechanism. The key ring 19 allows the key fob 10 to be attached to another object for safe keeping.

Figure 13:
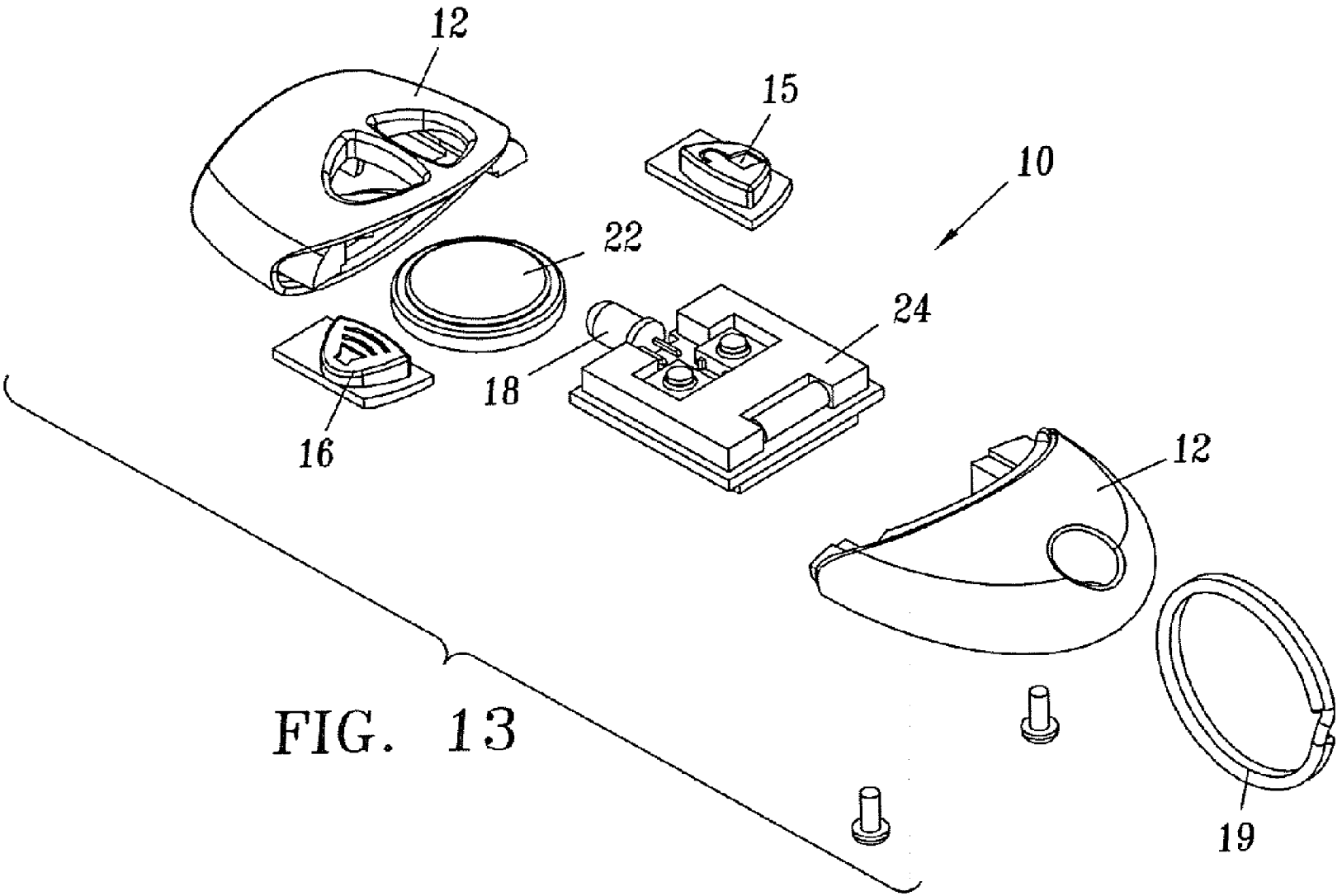
FIG. 13 is an exploded view of the key fob shown in FIG. 3.

FIG. 13 best illustrate the inner components of the key fob 10. The inner components of the key fob 10 generally include a power source 22, such as, for example, a coin cell battery, a printed circuit board (PCB) with microprocessor 24, and an IR LED 18. Displacement of the activation buttons 14 will cause the microprocessor 24 to send out a signal to the lock 20 through the IR LED 25. Furthermore, the housing 12 may include a mechanism, such as, for example, a door or separable housing components, to allow access to the inner components, such as the power source, of the key fob.

As such, the most general aspect of key fob 10 is that it is a device that is capable of sending a message or code to the lock 20 from a distance away from the lock. This code or message can be sent in a variety of ways, and is only illustrated herein as an IR signal as an example.

The lock 20 as shown in FIGS. 4-7 and 12 and 14 includes a shackle 30, outer body 35, IR lens 36 piezo cap 38, lock button extension 40 and lock cylinder 42. These components make up the external components of the lock 20 and provide a dual means for unlocking an objected secured by the lock 20.

The shackle 30, as shown in the Figures, is a u-shaped metal bar including a heel portion 43 and a toe portion 44 that each enter the outer lock body 35 through shackle holes 45. An object to be secured is placed between the shackle 30 and the lock outer body 35 in a traditional lock fashion. When the shackle 30 is secured within the lock outer body 35, the object is secured by the lock 20. When the shackle 30 is removed from the outer lock body 35, the object is no longer secured by the lock 20. Further, as shown in the Figures, the shackle 30 may optionally include a protective coating 47 to help prevent scratching of objects secured within the shackle. In some embodiments the entire portion of the shackle 30 that protrudes from the outer lock body 35 when in the locked position is coated with protective coating 47. In other embodiments, only a portion of the shackle 30 is coated with protective coating 47, thereby facilitating attachment of the lock 20 to another object, such as a bike. The shackle 30 further includes a locking notch 49 on each of the heel portion 43 and the toe portion 44. The locking notches 49 are used to secure the shackle 30 in the locked position, as discussed further below.

Figure 12:
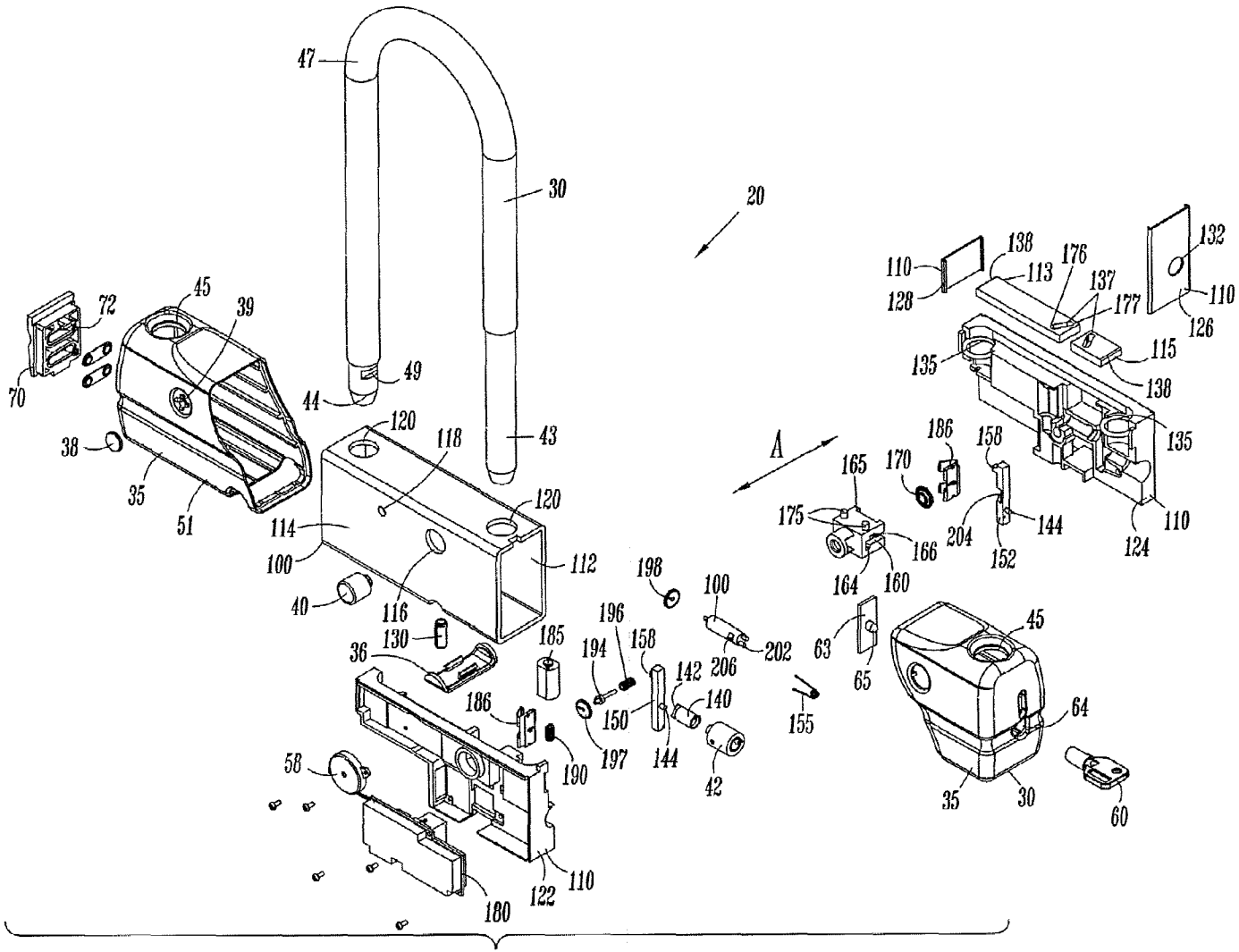
FIG. 12 is an exploded view of the lock shown in FIG. 2.

The outer body 35 is generally a plastic material and generally provides protection if the inner lock components from environment and further may provide enhanced aesthetic qualities for the lock 20. As shown in FIG. 12, the outer body 35 may comprise two separate components, such as the right outer housing 50 and the left outer housing 51. The right outer housing 50 and the left outer housing 51 may be attached in any conventional manner, such as, for example, snap fit, adhesion, staking or mechanical fasteners. It should also be appreciated by one skilled in the art that the outer housing 35 may be comprised of a single piece.

The piezo cap 38 is generally located on the front surface 55 of the outer lock body 35, although it can be located anywhere on the lock body. The piezo cap 38 covers aperture 39 in the outer lock body 35. The piezo cap 38 allows sound from the piezo transducer 58 to exit from within the lock. The sound from the piezo transducer 58 may also escape through other portions of the lock, such as, for example, the shackle holes, battery door, cylinder door and IR lens, making it difficult to silence. The piezo transducer 58 can produce sound to signal a variety of functions. Examples of the signals produced by the piezo transducer 58 include user lock mode identification sounds and an audio alarm sound when an alarm is triggered, as discussed further below.

Figure 14:
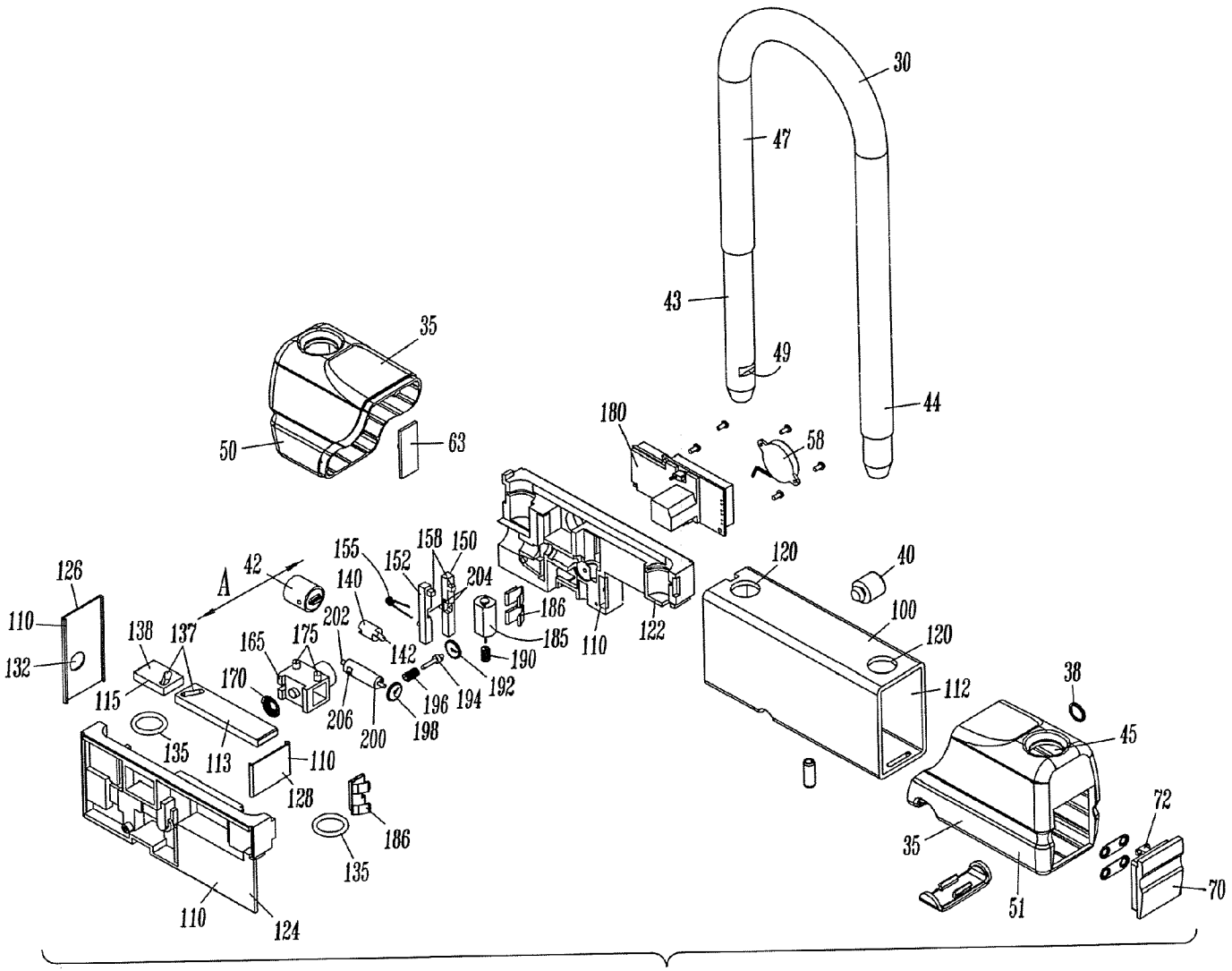
FIG. 14 is a reverse angle exploded view of the lock shown in FIG. 2.

The lock 20 further includes a lock cylinder 42 which may optionally be covered by a lock cylinder door 63. The lock cylinder 42 is used to mechanically unlock the lock 20. As shown in FIGS. 12 and 14, a key 60 is inserted into the lock cylinder 42 and turned. This action unlocks the lock 20, as discussed below. The lock cylinder door 63 can be used to selectively access the lock cylinder 42, thereby protecting the lock cylinder from the environment when not in use. As shown in FIGS. 4-7, the lock cylinder door 63 is a moveable piece of within the outer body 35 that slides up and down to uncover and cover an aperture 64 in the outer body 35 that provides access to the lock cylinder 42. A knob or protrusion 65 can be placed in the lock cylinder door 63 to provide for easier movement of the lock cylinder door.

IR lens and detector 36 is located on the bottom of the front face 55 of the lock outer body 35, although it can be located anywhere on the lock 20 where it can readily receive an IR signal. The IR lens 36 can be any type of IR lens capable of receiving an IR signal. However, in some application, an IR lens which filters out a portion of sunlight may be required for optimal operation of the lock. In one embodiment, the IR lens 36 is a plastic component from LNP, specifically a Colorcomp Lexan 141 BL5-321-1 IR lens. The IR detector is positioned behind the IR lens, and may be located on a PCB or elsewhere in the lock.

The lock outer body 35 may further include a battery door 70, which is retained in the locked position by the shackle 30 holding a t-shaped retention feature 72 that protrudes from the battery door 70 and rests under one leg of the shackle 30. When the shackle 30 is removed, the battery door 70 can be slid upward towards the top of the lock, thereby disengaging the t-shaped retention feature 72 on the lower and inside edge of the battery door 70. Removal of the battery door 70 provides the user with access to the battery 320. The battery can be any suitable power source, such as, for example, lithium "camera-type" batteries, such as CR2, or alkaline, such as AA-size batteries. Optionally, jumper holes (not shown) on the outside of the lock 20 allow the electronics internally to be powered by an external power source, such as, for example, by a battery with two paper clips or wires. The optional jumper holes allows the user to power the lock 20 in the event of a power failure and when the mechanical key operation of the lock is not available. The use of the jumper holes also allows for the battery door 70 to be secured when the lock 20 is in the locked position. Although this is not required, such operation is desirable to avoid unauthorized persons for tampering with the lock 20.

Furthermore, it should be appreciated that the power source can be any suitable source, including, but not limited to batteries, fuel cells, solar power, piezo, or the like.

The internal components of the lock 20 include a main housing 100, an inner housing 110, an electronically operated locking mechanism, a mechanically operated locking mechanism, locking latches 113 and 115 and an electronics system. While the electronically operated locking mechanism and mechanically operated locking mechanism share some components, each mechanism operated independently of the other to engage and disengage the locking latches 113 and 115 with the notches 49 in the shackle 30. Furthermore, one skilled in the art should appreciate that the components of the locking mechanisms are merely illustrative examples and that other locking mechanisms can be used to accomplish the same functions. These other such locking mechanisms are intended to be covered within the scope of this application.

The main housing 100 houses the inner housing 110 and generally provides the structural support for the lock 20. The main housing 100 is preferably metal to protect the internal components of the lock 20. The main housing 100 should provide minimal access points to the internal components of the lock 20, thereby assisting in the maintenance of the integrity of the lock. The open side walls 112 of the main housing 100 allow for insertion of the inner housing 110 and access to the batteries. The front wall 114 includes an aperture 116 for the lock button extension 40 and an aperture 118 near the piezo transducer 58 to allow for sound to escape from the internal portion of the lock. In addition, the main housing 100 includes a shackle aperture 120 corresponding to each leg of the shackle 30. Each leg of the shackle 30 can pass through shackle holes 45 in the outer housing 35 and through the shackle apertures 120 in the main housing 100 to allow interaction with the locking latches 113 and 115, which reside on the top of the inner housing 110.

The inner housing 110 generally includes several pieces that are fit together and then inserted into the main housing 100. As shown in FIGS. 12 and 14, the inner housing 110 may include a front portion 122, a rear portion 124, a right end clip 126 and a left end clip 128. These components can be connected in any fashion, including, but not limited to, snap fit, adhesion, staking, or mechanical fixtures. The inner housing 110 is then inserted into main housing 100 and fixed there by body pin 130. The inner housing 110 is generally molded to retain the components of the locking mechanisms. At least one portion of the inner housing 110 includes an aperture 132 that allows access to the lock cylinder 42. The inner housing 110 may also be fitted with o-rings 135 around each of the shackle apertures 120. The o-rings 135 assist in protecting the inner components from the environment. The o-rings 135 may also be used to provide a friction fit on the shackle 30, such that the shackle will not easily fall out of the lock when in the unlocked position.

The locking latches 113 and 115 are secured between the main housing 100 and the inner housing 110 and include slots 137. Although the locking latches 113, 115 are shown as a short latch and a long latch, one skilled in the art should appreciate that the length of the latches depends on the design of the lock 20. The slots 137 are located at the opposite end of the latches 113, 115 as the shackle retaining end 138. When the shackle 30 is placed within the lock 20 the shackle retaining ends 138 of the latches 113, 115 engage the notches 49 in the shackle, thereby retaining the shackle. The slots 138 are angled from the front of latches 113, 115 to the back of latches 113, 115 and interact with the locking button 165, as discussed below, to move the latches 113, 115 into and out of engagement with the notches 49 in the shackle 30.

Figure 15:
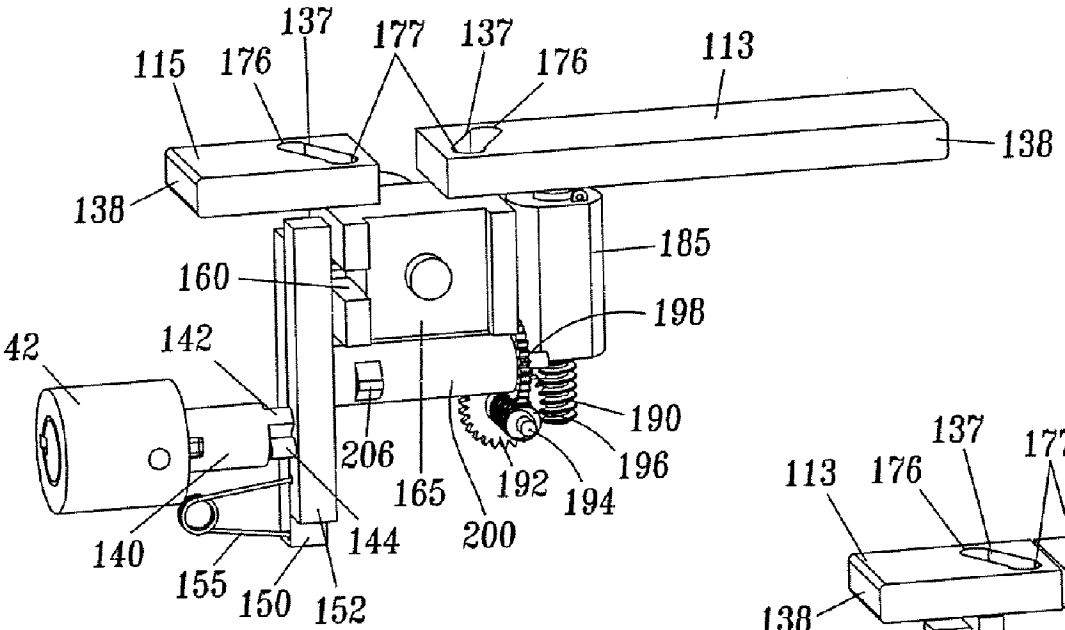
FIG. 15 is a cross-sectional view of a lock showing the interaction between the locking button, latches, cam shaft and cylinder extension when in the locked position.
Figure 16:
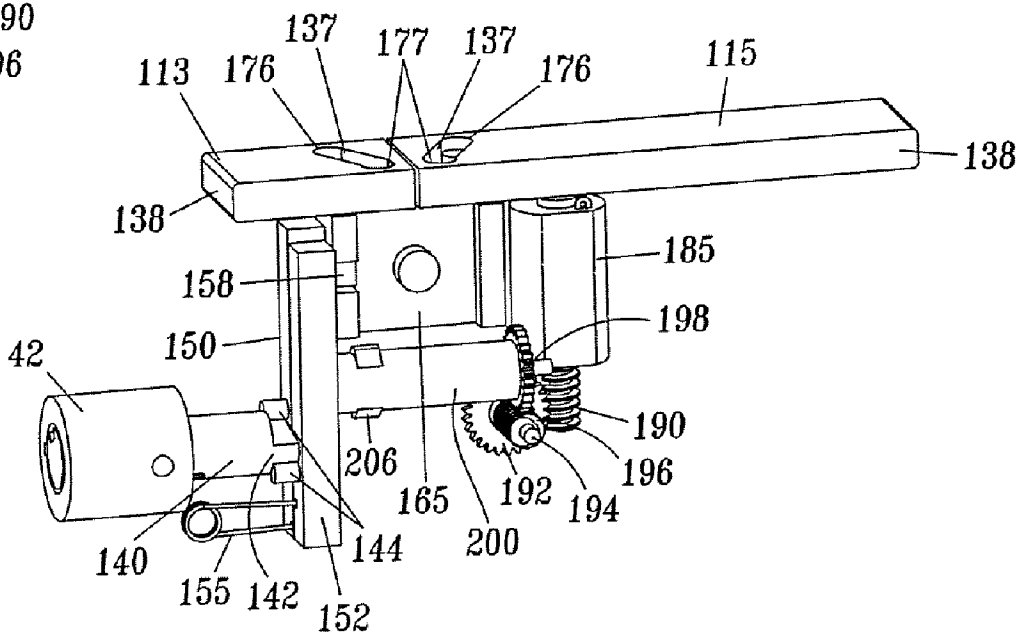
FIG. 16 is a cross-sectional view of a lock showing the interaction between the locking button, latches, cam shaft and cylinder extension when in the unlocked position.

The components of the mechanically operated locking mechanism are best illustrated by describing the operation of the mechanism. FIGS. 15 and 16 illustrate the components of the locking mechanism in the locked and unlocked position, respectively. To operate the mechanically operated locking mechanism to move it from the locked position to the unlocked position, a key 60 is inserted into the lock cylinder 42 and rotated. The rotation of the lock cylinder 42 rotates the cylinder extension 140, which is coupled to the lock cylinder. The cylinder extension 140 includes a flange, or protrusion, 142 that selectively engages a post 144 on each of a front locking lever 150 and a back locking lever 152. As the cylinder extension 140 rotates, the flange 142 pushes upward against the post 144 on the front locking lever 150 and downward against the post 144 on the rear locking lever 152. A torsion spring 155 can be used to force the front and rear locking levers 150, 152 back into the locked positions upon release of the lock cylinder 42.

The locking levers 150, 152 each include a protrusion 158 that rides in a slot 160 in the locking button 165. The slot 160 in the locking button 165 is generally linear, with two notches 164, 166. In the locked position, the protrusion 158 on the front locking lever 150 rests in the front notch 164, while the protrusion 158 on the rear locking lever 152 rests in the rear notch 166. The rotation of the lock cylinder 42 causes the protrusion 158 of the front locking lever 150 to raise up out of the front notch 164 and causes the protrusion 158 of the rear locking lever 152 to drop out of the rear notch 166, thereby enabling the locking button 165 to be moved forward and backward, as shown as A. A locking button spring 170 forces the locking button 165 forward. When the locking button extension 40 is pushed, and the protrusions 158 are out of their respective notches 164, 166, the locking button 165 is moved backwards against the force of the locking button spring 170.

As the locking button 165 is moved backwards against the force of the locking button spring 170, two knobs, or protrusions, 175 ride within the slots 137 in the latches 113, 115. As best shown in FIGS. 15 and 16, the slots 137 are angled from front to back of the latches 113, 115, with the end of the slot closer to the retention end 138 towards the back of the latches 113, 115. When the locking button knobs 175 are at the front end 176 of the slots 137, the latches 113, 115 extend outward to engage the shackle 30 in the locked position. When the locking button knobs 175 slide toward the back end 177 of the slots 137, the latches 113, 115 are pulled inward away from the shackle 30, thereby removing the shackle retention ends 138 from engagement with notches 49. As such, the lock 20 is now in the unlocked position and the shackle 30 can be removed from the lock body.

When the locking button extension 40 is released, the locking button 165 moves forward due to spring force from the locking button spring 170, thereby moving the locking button knobs 175 to the front end 176 of the slots 137 in the latches 113, 115. As the knobs 175 move toward the front end 176 of the slots 137, the latches 113, 115 move outward towards the shackle 30. When the shackle 30 is placed through the shackle apertures 120, the outward movement of the latches 113, 115 will cause the shackle retention ends 138 of the latches 113, 115 to engage the notches 49 in the shackle 30. So engaged, the shackle 30 is now retained in the lock body and the lock 20 is now in the locked position.

The electronically operated locking mechanism operates in a separate and independent manner to move the protrusions 158 on the locking levers 150, 152 from their corresponding notches 164, 166 in the slot 160 in the locking button 165. Once the protrusions 158 are moved, the locking button 165 is free to move with force applied to the locking button extension 40 against the force of the locking button spring 170 to move the latches 113, 115 into and out of engagement with the shackle notches 49. This aspect of the electronically operated locking mechanism operates the same way as the mechanically operated locking mechanism.

In order to move the protrusions 158 on the locking levers 150, 152 to allow movement of the locking button 165 via the electronically operated locking mechanism, a coded IR signal must be sent from the key fob 10, or other signal source, and received by IR lens 36. The IR lens 36 transmits the IR signal to a printed circuit board assembly (PCB) 180 located within the lock main body 100. The PCB 180 will decode the signal to determine if the proper code has been received. If the code matches a programmed user key code, then the lock will unlock. In order to unlock the lock, the PCB 180 sends a signal to the motor 185 which draws power from a power source, such as a set of batteries with battery contacts 186. The motor 185 drives worm gear 190, which in turn drive spur gear 192, which drives drive shaft 194. The drive shaft 194 is used to drive worm gear 196, which drives spur gear 198, which drives cam shaft 200. Although the two worm gear and two spur gear drive assembly can be replaced with other drive mechanisms, this drive mechanism is preferred due to its ability to provide the desired torque with reasonably low power consumption.

The cam shaft 200 includes two protrusions 202, one protrusion interacting with a notch 204 on the front locking latch 150 and one protrusion interaction with a notch 204 on the back locking latch 152. As the cam shaft 200 rotates, one protrusion 202 contacts the notch on the front locking latch 150 lifting it upwards, while one protrusion 202 contacts the notch 204 on the rear locking latch 152 pushing it downward. Movement of the front and rear latches 150, 152 moves the protrusions 158 from their respective notches 164, 166 in the slot 160 on the locking button 165.

Figure 18:
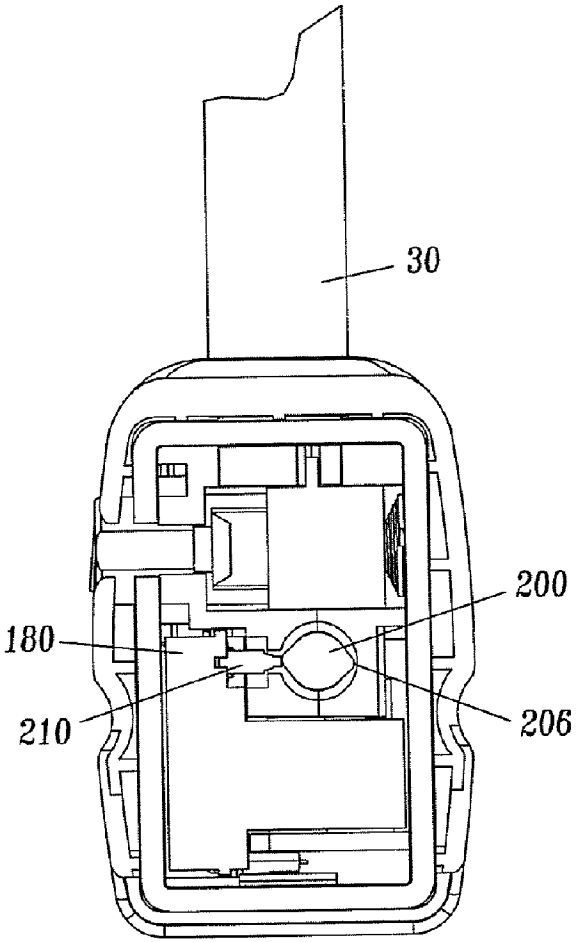
FIG. 18 is a cross-sectional view of a lock illustrating camshaft interaction with push-button on the PCB while the motor is stopped.
Figure 17:
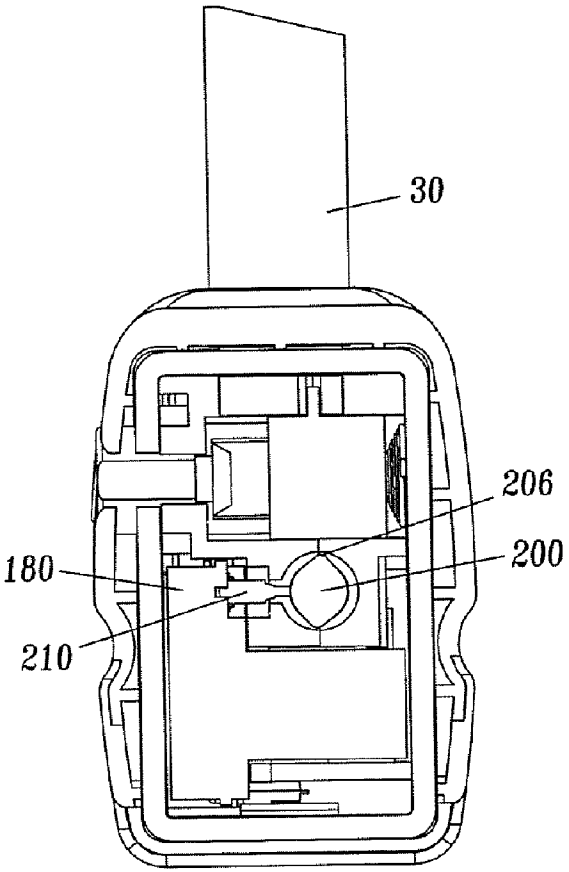
FIG. 17 is a cross-sectional view of a lock illustrating camshaft interaction with push-button on the PCB while the motor is running.

As best shown in FIGS. 17 and 18, the cam shaft 200 includes two cam features 206 located 180 degrees apart from one another. When the cam shaft 200 rotates to align one of the cam features 206 with the PCB 180, the cam feature 206 closes a switch 210 on the PCB 180. By closing switch 210 on the PCB 180, a signal is sent to stop the motor 185. Consequently the cam shaft 200 is always stopped in a home position. Because the cam shaft 200 rotates 180 degrees per unlocking operation, the cam shaft 200 has two home positions and thus two cam features 206.

Figure 20:
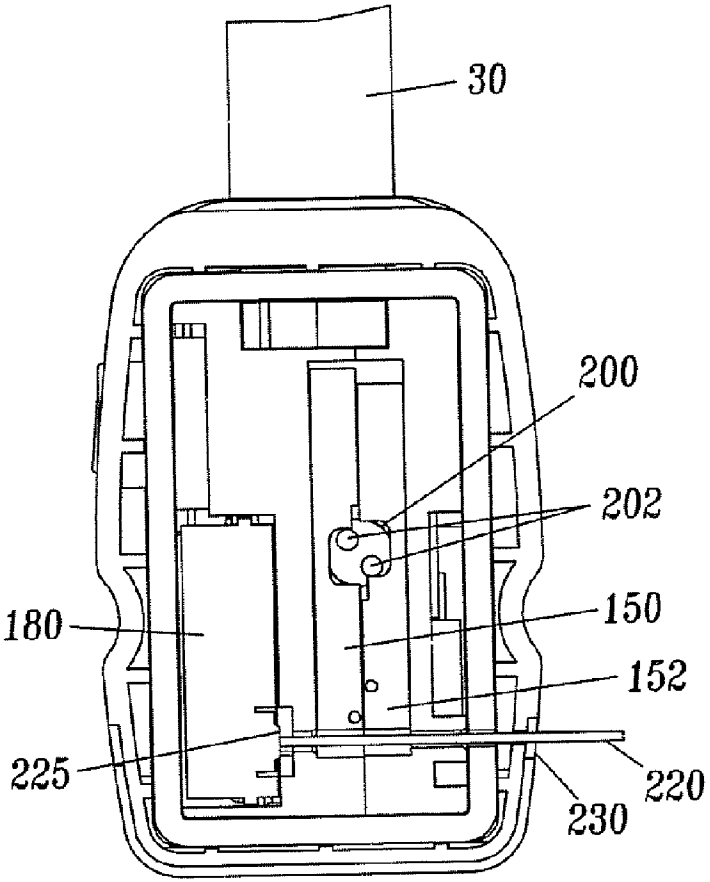
FIG. 20 is a cross-sectional view of a lock illustrating the lock internal components in the unlocked position and the access hole for reprogramming.
Figure 19:
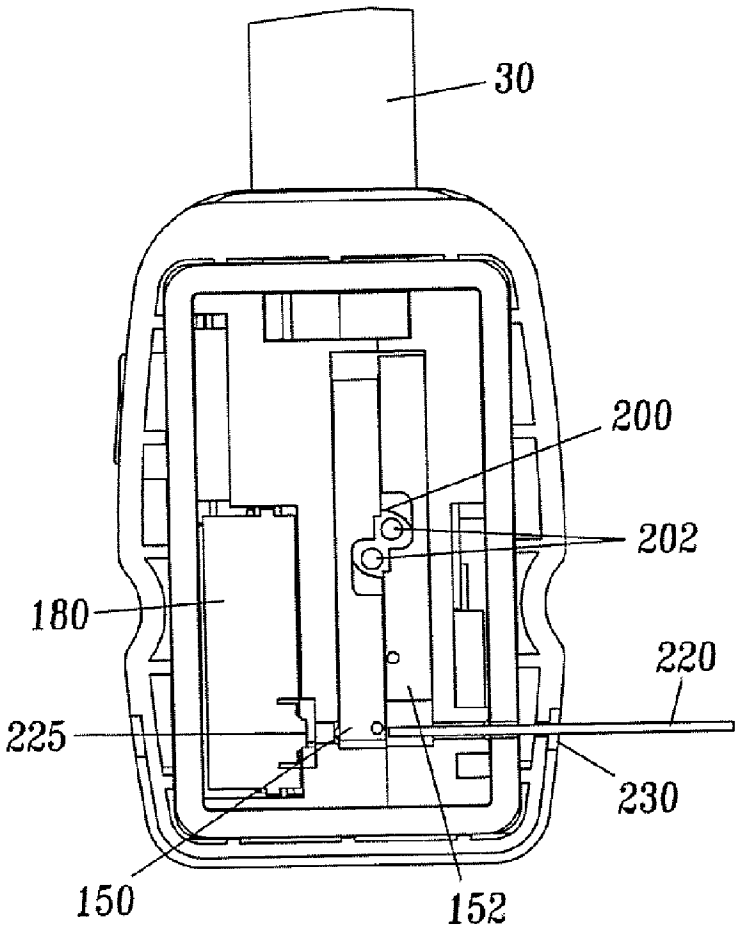
FIG. 19 is a cross-sectional view of a lock illustrating the lock internal components in the locked position and the access hole for reprogramming.
Figure 21:
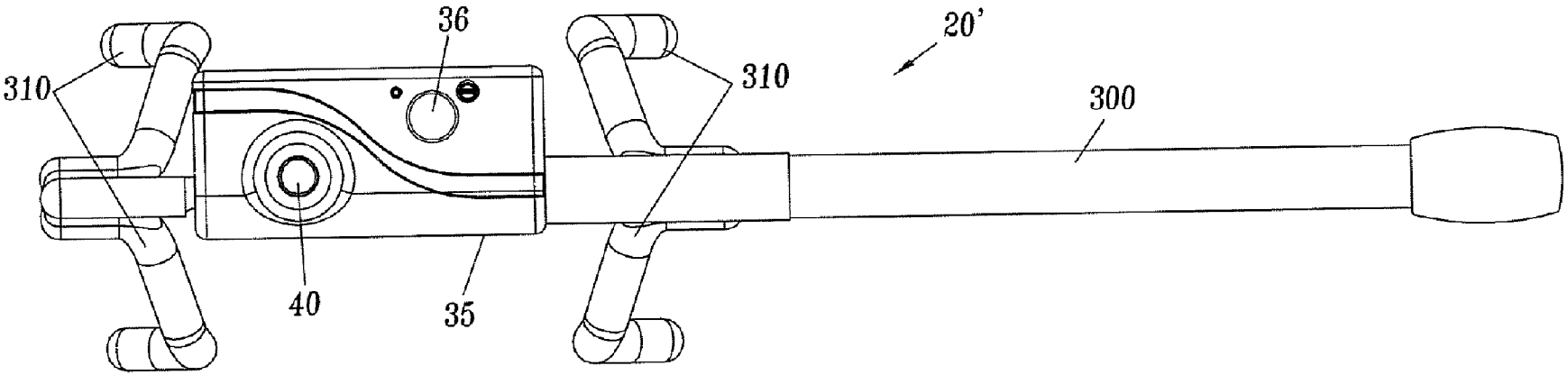
FIG. 21 is a top view of a steering wheel lock incorporating the components of the present invention.
Figure 22:
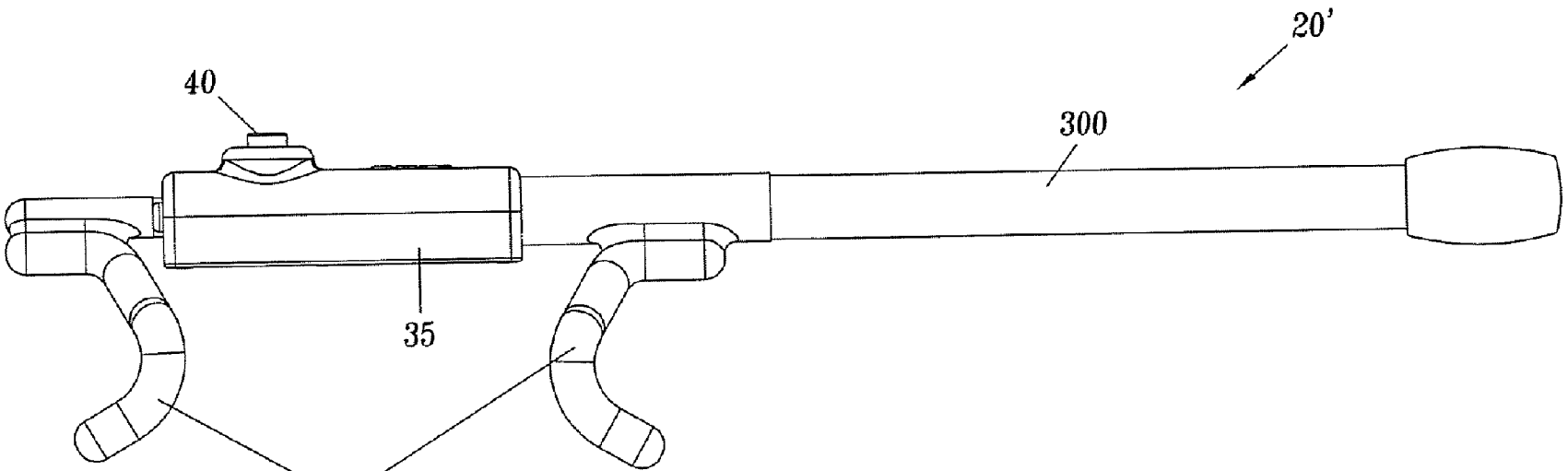
FIG. 22 is a side view of the steering wheel lock of FIG. 21.
Figure 23:
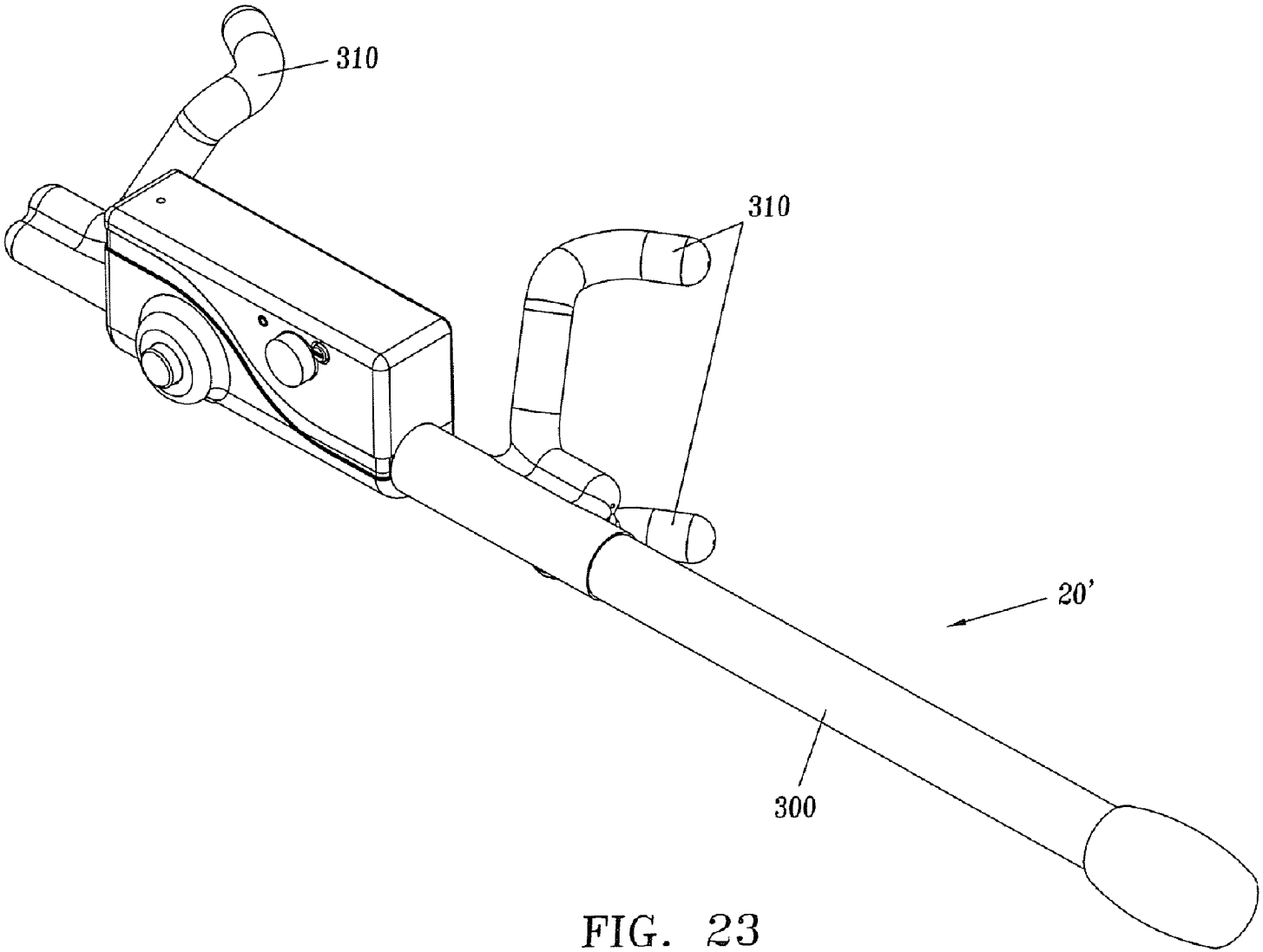
FIG. 23 is a perspective view of the steering wheel lock of FIG. 21.
Figure 24:
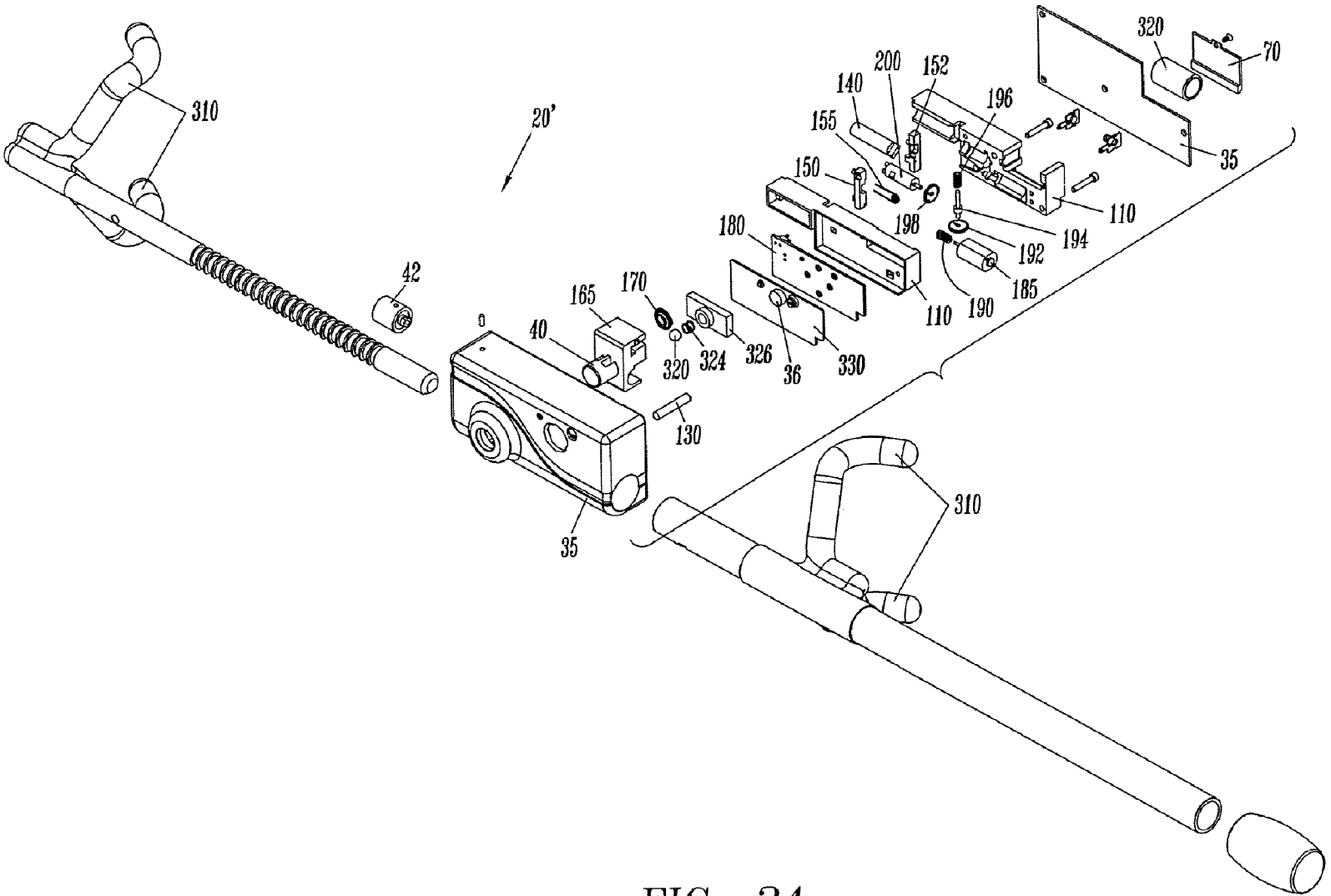
FIG. 24 is an exploded view of the steering wheel lock of FIG. 21.

As best shown in FIGS. 19 and 20, a tool, such as a pin, 220 can be used to access a PCB reset switch 225 through access hole 230, which is used to learn new key fob codes and delete selected or all key fobs codes. As such, a single user can program a single key fob to access multiple locks or multiple users can each program a different key fob to allow access to a single lock. The PCB reset switch 225 is used to add and delete key fob codes, thereby controlling access to the lock 20. In order to prevent access to the PCB reset switch 225 when the lock 20 is in the locked position, the PCB reset switch 225 is blocked by the front locking lever 150. Thus, as shown in FIG. 19, when a tool 220 is placed through the access hole 230 when the lock is in the locked position, front locking lever 150 blocks access to the PCB control switch 225. When the lock 20 is in the unlocked position, as shown in FIG. 20, the tool 220 can access the PCB reset switch 225. This is because the front locking lever 150 has moved upward towards the lock shackle 30 and out of the path to the PCB reset switch 225. The PCB reset switch 225 can use the piezo transducer 58 to produce audible signals to allow the user to access different functions of the PCB reset switch 225. For example, one set of audible signals could be used to signal a key fob code learn function, while another set of audible signals could be used to signal a key fob deletion function.

An optional motion alarm can be incorporated into the security device as part of the PCB 180. The motion alarm circuit 240 and a vibration circuit 242 are shown schematically in FIG. 1 as it interacts with the other electrical components of the lock 20. Vibration sensors, or the like, are used in the electronics to sense movement and notify the microcontroller 181 on the PCB 180. The microcontroller then determines if the motion is severe enough to set off the alarm. This can be accomplished in a number of ways, such as looking for a predetermined number of positive vibration or movement actions within a predetermined duration of time. Once the microprocessor determines that the motion is severe enough, an alarm can be triggered, which could be audio, such as a series of sounds produced by the piezo transducer 58, visual, both or some other method of providing an alarm signal. The alarm notifies bystanders and the rightful owner, if in range, that the device is being tampered with. The alarm may also be set-up to provide notice to the owner or some other specified location through long distance communication, such as a cellular call. The notification can be received on the fob or any other device, such as, for example, a cellular phone or computer. Such remote alarms may also provide an alarm reset button that can be transmitted back to the lock 20, such as, for example, the alarm key 16 on the key fob 10. The device can notify the owner of a triggered alarm with a series of audio sounds, or visual displays, after the device is unlocked or disarmed. The alarm method, sensitivity, magnitude, and features may vary as with other alarms in similar fields.

The piezo transducer 58 may be used to provide audible signals in a variety of functions. The piezo transducer 58 may be used to provide an audile alarm when the alarm is triggered. The piezo transducer 58 may also provide audible signals when locking or unlocking the lock 20. In addition, as mentioned above, the piezo transducer 58 may provide audible signals to notify the functional modes activated by the PCB reset switch 225. One skilled in the art should appreciate that the piezo transducer 58 is an optional component and that one or more LED's, or other signal mechanisms, can be used in place of or in connection with the piezo transducer.

In order to engage the lock 20 shown in FIG. 2, the shackle 30 is removed from the lock body and secured around an object, such as a bike wheel, school locker, hasp, or the like. The shackle 30 is then placed through the shackle holes 45 in the outer housing 35. The locking button extension 40 can be pressed to move the locking latches 113, 115 out of the way of the shackle holes 45. Alternatively, the lock shackle 30 can move the locking latches 113, 115 by providing a camming surface that acts against the shackle retention ends 138 of the locking latches 113, 115. Once the shackle 30 is in place in the shackle holes 45, the shackle retention ends 138 of the locking latches 113, 115 engage the notches 49 in the shackle 30 thereby securing the shackle within the lock body. Optionally, the alarm can then be activated.

To remove the lock 20 from the object which it is securing, the alarm, if activated, is first turned off. Then the lock can be unlocked by either pressing the unlock button 15 on the key fob 10 or inserting the key 60 into the lock cylinder 42 and rotating the key 60. If the unlock button 15 is pressed, the key fob 10 transmits a security code from the IR LED 18, which is detected by the IR lens 36 on the lock 20 and transmitted to the PCB 180 for processing. If the correct code is received, the electronically operated locking mechanism activates to move the locking latches 113, 115 from engagement with the notches 49 in the shackle 30. The shackle 30 can then be removed from the lock body to release to the object from the lock. If the key 60 is used, the turning of the lock cylinder 42 activates the mechanically operated locking mechanism to move the locking latches 113, 115 from engagement with the notches 49 in the shackle 30. The shackle 30 can then be removed from the lock body to release to the object from the lock. The mechanically operated locking mechanism allows the user to gain access in a dead battery or electronics failure situation.

FIGS. 21-24 illustrate another embodiment of the lock 20', which is designed to engage a vehicle steering wheel. The operation of the lock 20' is nearly identical to that described above. However, in place of shackle 30, the lock 20' has an adjustable shaft 300 that includes four hooks 310 for engaging a steering wheel. Lock 20' differs further from lock 20, in that the locking latches 113, 115 are replaced by a ball detent 320, ball detent spring 324 and detent retention plate 326. When the lock button extension 40 is fully extended, the ball detent 320 rests in one of the grooves in the adjustable shaft 300. As the shaft 300 is extended, the spring 324 allows the ball detent 320 to ratchet from groove to groove. The detent retention plate 324 holds the ball detent 320 and detent spring 324 in place. When either the mechanically operated locking mechanism or electronically operated locking mechanism moves the locking levers 150, 152 to allow the locking button 165 to move inwards, as described above, the shaft 320 is captured between the ball detent 320 and the locking button 165. On one side, the ball detent 40 is pushed against the spring 324 to compress the spring against the detent retention plate 324. On the other side, the locking button 165 includes one or more ridges (not shown) that catch against the grooves in the shaft 300. As such, the shaft 300 cannot be removed from the lock housing 35.

Furthermore, the lock embodiment 20' includes an IR detector 36 located on plate 330. When the correct code is transmitted to the IR detector 36, the electronically operated locking mechanism is activated to unlock the lock. One skilled in the art should appreciate that the IR detector can be replaced by any other means of receiving an electronic code, such as, for example push buttons, switches, RFID or radio frequency detector or the like.

Figure 25:
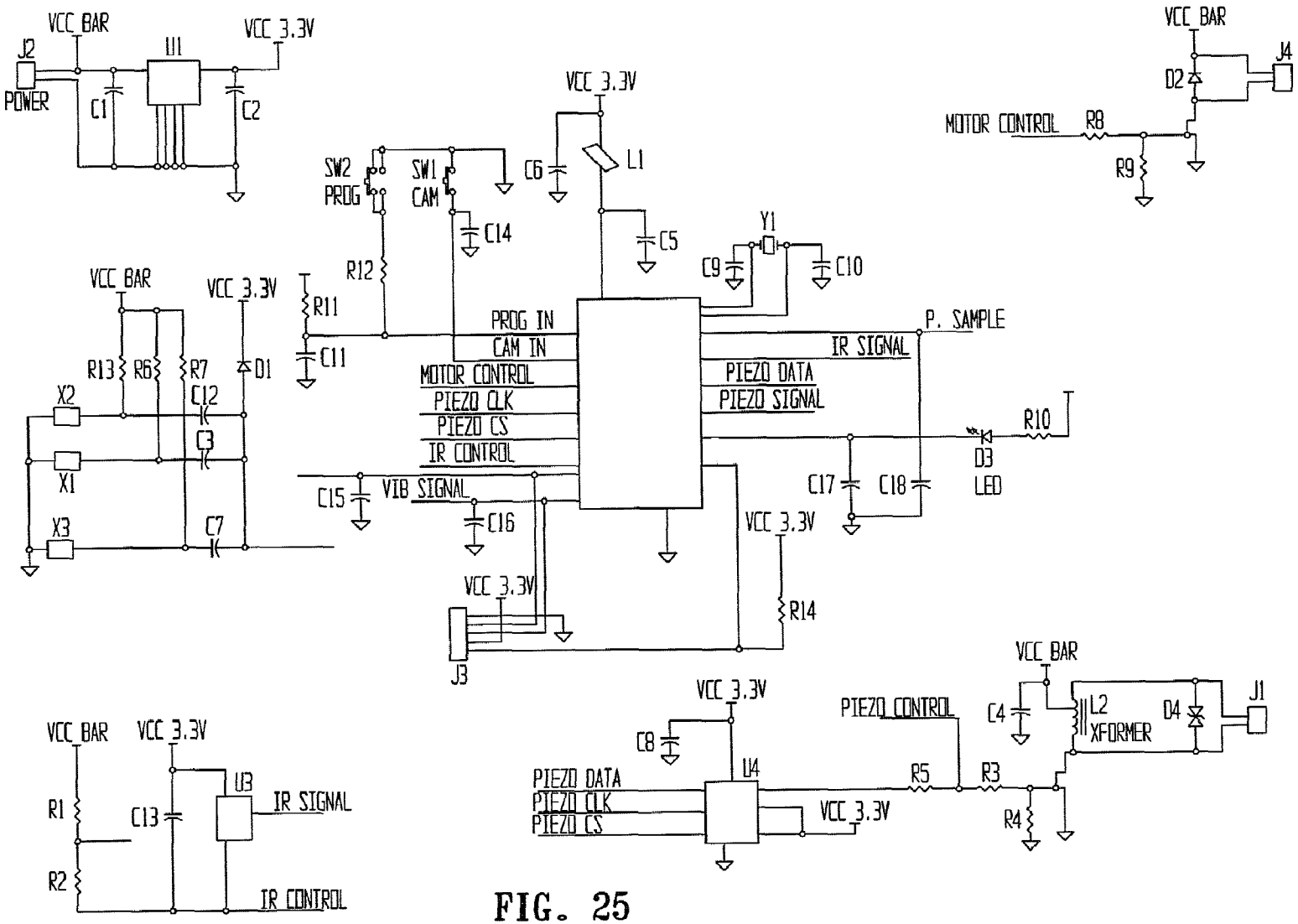
FIG. 25 is an illustrative example of a circuit for a key fob.
Figure 26:
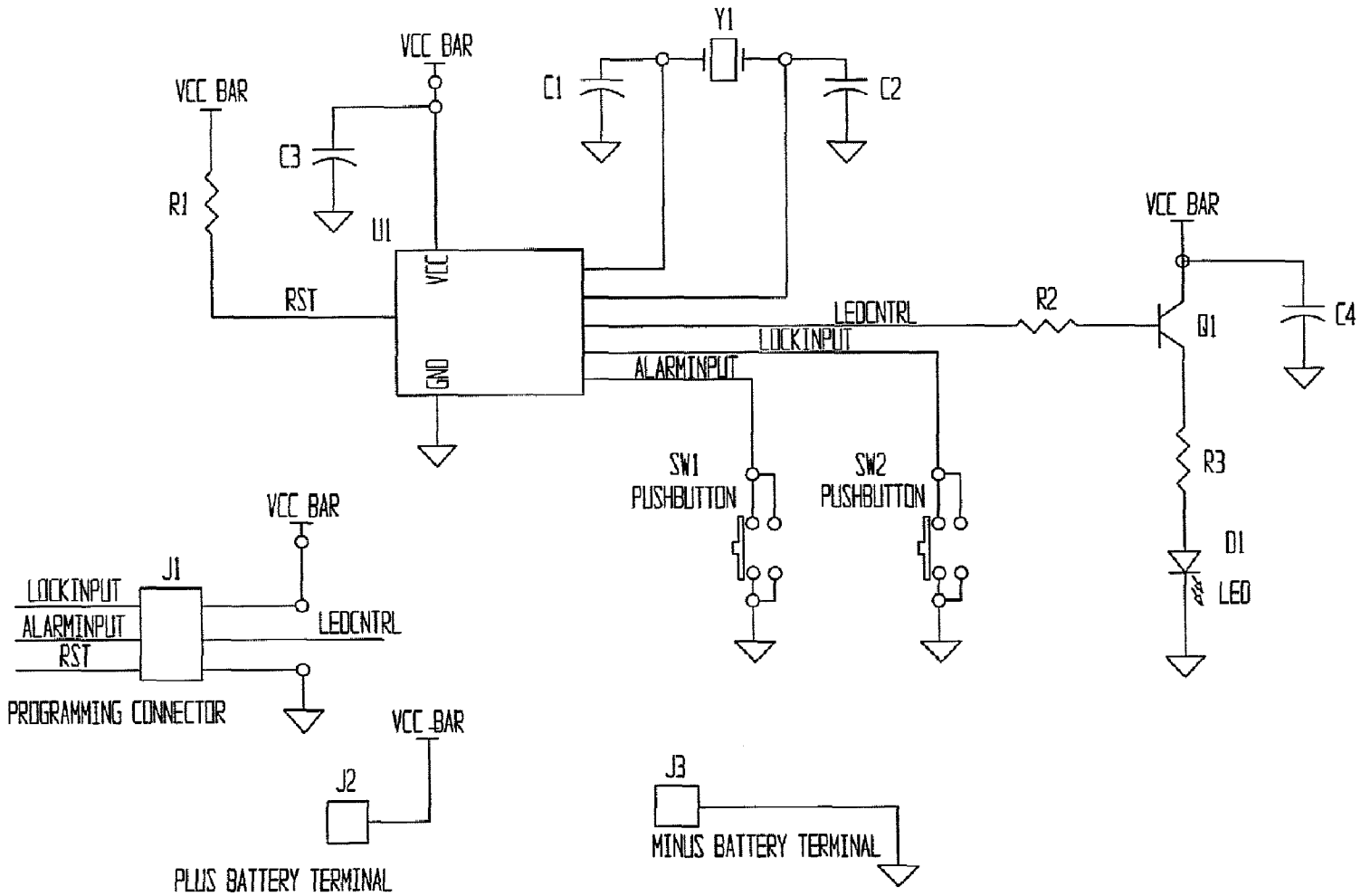
FIG. 26 is an illustrative example of a circuit for a lock.

The circuits for the key fob 10 and lock 20 are shown in FIGS. 25 and 26, respectively. One skilled in the art should appreciate that such circuits are merely illustrative examples and that other circuits can be used in the key fob and lock. A general description of the lock circuit is contained below.

Figure 1:
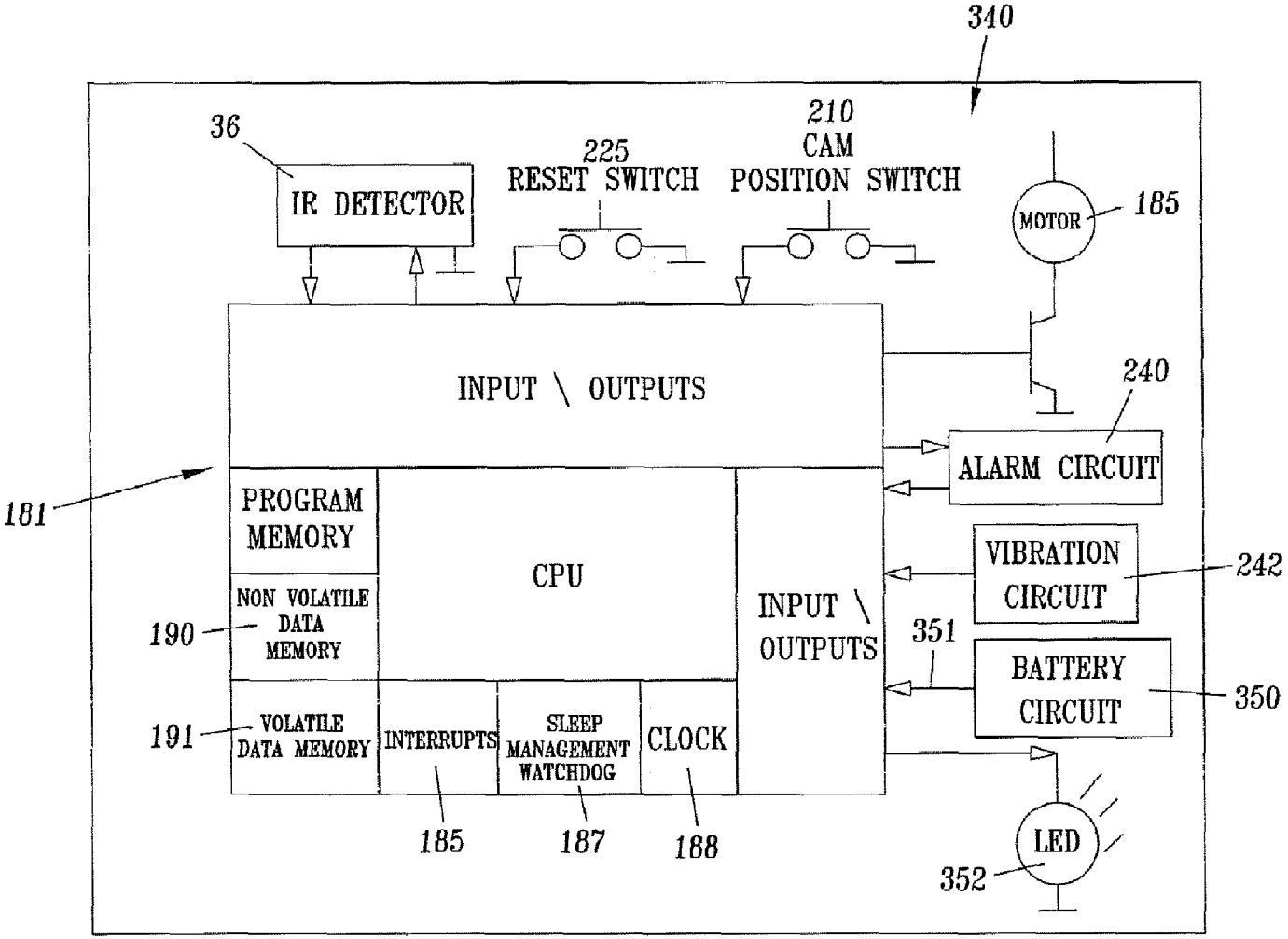
FIG. 1 is a schematic of an illustrative example of a circuit that can used in connection with the lock of the present invention.

As shown schematically in FIG. 1, the lock circuit 340 detects the output from vibration sensors 242, an infrared serial data stream from the IR detector 36, the motor cam position switch 210 and the PCB reset switch 225. Battery voltage can also be monitored by a battery circuit 350. The lock circuit 340 controls the motor 185, LED (Light Emitting Diode) 352 and a piezo alarm circuit 240. It should be appreciated that these elements are optional and are based on the desired features and functions of the lock 20.

The over all circuit, as shown in FIG. 1, is designed around the microcontroller 181. The microcontroller 181 has enough digital input lines to read the vibration sensors 240, the infrared data stream from the IR detector 36, information from the motor cam position switch 210 and information from the PCB reset switch 225. The microcontroller 181 also includes digital output lines to control the motor 185, one or more LED's 352, and the alarm circuit 240. An analog input 351 may also be incorporated to monitor the battery voltage. The microcontroller 181 supports external interrupts from the vibration sensors 242 and the PCB reset switch 225. To conserve battery life, the microcontroller 181 has a low power down mode that can be exited from either of the two external interrupts 185 and a time out event from a watchdog timer circuit 187 which receives information from an internal clock 188. The watchdog wakeup allows for periodic searches for valid infrared messages received by the IR detector 36. The microcontroller 181 includes internal programmable non-volatile memory 190, such as $E^2$ memory, to store user added key fob addresses as well as volatile data memory 191. A unique alarm circuit 240 was developed to reduce the required band width of the microcontroller 181 by off loading the alarm generation to an external serial $E^2$ memory.

Conventional circuits can be used for monitoring the motor cam position switch 210, PCB reset switch 225 and reading the battery voltage 350.

The infrared data stream is monitored using an infrared detector 36 that has an infrared photo detector fed into a preamplifier and active filter that removes unwanted signals from its data stream output. The infrared detector 36 requires an external supply voltage. To reduce power consumption, an output from the microcontroller 181 is used to turn off the infrared device 36 when the microcontroller 181 is in low power mode.

The alarm circuit 240 uses a piezo bender for the active sound producing device. This device has a driving transistor and transformer to provide the driving energy. The piezo bender driving circuit is sourced data from the output of a serial $E^2$ memory device. The serial $E^2$ memory is clocked from a PWM (Pulse Width Modulated) output from the microcontroller 181. The PWM output is a background function from the microcontroller 181 that after being enabled does not require support from the active running program until it's desired to stop the alarm. By using the external $E^2$ memory to pump data into the piezo bender, the microcontroller is off loaded from providing data to the piezo bender. Data in the external $E^2$ memory is loaded either during product manufacturing or a compressed audio image is stored in the microcontroller 181 during manufacturing. In the later, the audio image is decoded during product power up and stored to external $E^2$ memory in preparation for an alarm event. The microcontroller 181 supplies output control signals to the external memory device to program it.

The firmware detects, decodes and compares infrared messages received by the IR detector 36. The firmware also monitors and sums vibration events from the vibration circuit 242 and can monitor battery voltage from data received from the battery circuit 350. The firmware processes this information and controls a motor 181, an alarm 240 and a LED (Light Emitting Diode) 352 accordingly.

The firmware is built around an interruptible runtime/idle mode structure. The microcontroller 181 processes event inputs in runtime and after processing inputs, the microcontroller 181 outputs a variety of actions. The microcontroller 181 shuts down the majority of its resources to conserve power in the idle state, until it is interrupted.

Idle mode can be interrupted and forced into runtime mode through three different events. First, a watchdog event is implemented that wakes the microcontroller 181 from idle mode at a periodic rate anywhere from 800 mS to every eight seconds. The wakeup events purpose is to cause the runtime module to search for infrared messages detected by the IR detector 36. The second event is a hardware interrupt from the vibration detectors 242. This is required only when motion detection is turned on. The third event is a momentary push button event from the PCB reset button 225. The microcontroller 181 spends the majority of its time in idle mode. When in idle mode and no interrupts are being handled, the microcontroller 181 is stopped, thereby conserving battery power.

Runtime is constructed from a number of modules. The execution of the infrared module, motion detection module, motor control module, alarm module, and program module are all event controlled.

The infrared module is executed whenever idle mode wakes from a watchdog timer event 187. The infrared module enables the infrared detector 36 and runs an algorithm to determine if the format of the data indicates a possible message. In order to determine whether there is a possible message, the module attempts to decode a start bit and then a preamble. If both start bit and preamble are found, the module clocks in data until a post amble message is detected. If the post amble message is also correct, the module accesses non-volatile data memory 190 and checks for a message match. If a match is found, the message is analyzed to determine if it was a unlock message or a motion/alarm message. If it is an unlock message, the motor module is executed and the motion detection module is turned off. If it's a motion/alarm message, motion detection is toggled on or off. If the alarm is active at this time, the alarm is turned off and the runtime module is exited and processor switches back to idle mode. If no match was found the motion detection module is executed.

The motor control module drives the motor 185. The motor control module is only triggered by a positive message response from the infrared module. This module, using data from the cam position switch 210 for feedback, powers the motor to determine how much to rotate the cam shaft 200 in order to unlock the lock shackle 30. Upon closing the cam position switch 210, the motor control module shuts off the motor 185 and waits for a new positive message response from the infrared module.

The motion detection module has two components, a runtime module and an interrupt handler. The interrupt handler is triggered by a vibration sensor event from the vibration circuit 242. The handler, when enabled, counts the vibration events and clears the count if a preset time elapses without an event. The runtime module is executed at every watchdog event and will check the event count prepared by the interrupt. If the count exceeds a preset value, the alarm module is executed and the runtime is exited and processor switches back to idle mode.

The alarm module prepares the alarm and controls the microcontrollers PWM module that clocks the alarm. This module performs numerous activities to provide the alarm function. First, on power up, a compressed audio image stored in the microcontroller 181 is decompressed and stored into the external $E^2$ memory. Now the completed audio signal is stored in $E^2$ memory and just needs to be clocked into the hardware piezo bender driver circuit. When the alarm needs to be activated, the alarm module configures the $E^2$ memory to read data. The $E^2$ memory input/output lines are changed so the microcontrollers PWM module can clock the $E^2$ memory. The PWM module, after it is started, can provide clock signals to the $E^2$ memory without intervention from the runtime module. The infrared module can be executed at the same time in search of a message to turn off the alarm. When the alarm needs to be tuned off, the alarm module is again called to turn off the PWM module, change the input/output lines around and stop reads from the $E^2$ memory.

The program module is triggered by an external interrupt from the PCB reset button 225. By measuring how long the button is held down, or the number of times the button is pressed in a predetermined period of time, the program module determines if the user wants to learn a new key fob or erase stored key fobs. To learn new key fobs, this module calls the infrared module to locate new valid key fob data streams. If a new valid key fob address is received and there is enough space to store another address, the $E^2$ memory is updated with the new key fob. To erase key fobs stored in $E^2$ memory, all but the first key fob, which is factory installed, is erased from $E^2$ memory. As such, additional key fobs can be used to operate the lock. The PCB reset button 225 can not be accessed when the security device is locked, however it can be accessed in the unlocked position.

The invention has been described with reference to the preferred embodiment. Clearly, modifications and alterations will occur to others upon a reading and understanding of this specification. It is intended to include all such modifications and alterations insofar as they come within the scope of the appended claims or the equivalents thereof. The scope of the invention and claims are not limited in any way by the description of the preferred embodiments, which are provided only to illustrate various examples of the invention.

What is claimed is:

1. A lock comprising:

a locking member that is selectively secured within a lock housing;

one or more locking levers that are selectively moved between two positions:

a locked position, wherein said locking member is secured within said lock housing; and an unlocked position, wherein said locking member is released and can be removed from said lock housing;

an electronically operated locking mechanism that controls an electromechanical actuator that is coupled to the one or more locking levers, the actuator being configured to move the one or more locking levers between the locked position and the unlocked position; and a mechanically operated locking mechanism that is coupled to the one or more locking levers and configured to move the one or more locking levers between the locked position and the unlocked position without requiring energization of the electromechanical actuator;

wherein said electronically operated locking mechanism and said mechanically operated locking mechanism operate independent of one another, and are capable, each without action by the other, to move said one or more locking levers to said unlocked position, such that movement of the one or more locking levers by the mechanically operated locking mechanism occurs independently of the electromechanical actuator.

2. The lock of claim 1, wherein said locking member is a shackle.

3. The lock of claim 1, wherein said locking member is an adjustable shaft of a steering wheel lock.

4. The lock of claim 1, wherein said electronically operated locking mechanism includes a mechanism for receiving a coded message to unlock the lock from a remote signal generation source.

5. The lock of claim 1, wherein said electronically operated locking mechanism includes an IR detector for receiving coded unlock messages from a remote IR signal generation source.

6. The lock of claim 1, wherein said actuator includes a motor, at least two spur gears, at least one drive shaft, at least two worm gears, and a cam shaft, wherein rotation of the cam shaft moves the one or more locking levers to the unlocked position.

7. The lock of claim 6, wherein said cam shaft includes one or more protrusions that interact with a portion on said one or more locking levers to move the locking levers to said unlocked position when said cam shaft is rotated.

8. The lock of claim 7, wherein said cam shaft further comprises one or more camming features that close a switch to stop the rotation of the cam shaft when said one or more camming features align with said switch.

9. The lock of claim 1, wherein said lock body includes one or more apertures for receiving said locking member; and said lock further includes one or more 0-ring positioned around said one or more apertures for receiving said locking member.

10. The lock of claim 1, wherein said mechanically operated locking mechanism comprises a keyed lock cylinder and a cylinder extension, wherein insertion of a proper key into the lock cylinder permits rotation of the cylinder extension.

11. The lock of claim 10, wherein said cylinder extension includes a flange that interacts to a portion of said one or more locking levers to move the locking members to the unlocked position when said cylinder extension is rotated.

12. The lock of claim 1 further comprising a piezo transducer that provides an audible signal to indicate when the lock is locked or unlocked.

13. The lock of claim 1 further comprising an alarm system that can selectively be armed.

14. The lock of claim 13, wherein said alarm system includes one or more motion detectors that trigger an alarm signal when said one or more motion detectors sense a motion event.

15. The lock of claim 13, wherein said alarm system produces an audible alarm signal.

16. The lock of claim 13, wherein said alarm system provides an alarm signal to a remote device.

17. The lock of claim 13, wherein said alarm system includes an audible signal that is stored in a separate non-volatile memory source.

18. The lock of claim 1 further comprising a microcontroller that includes non-volatile memory source capable of storing one or more unlock codes.

19. A lock comprising:

a locking member that is selectively secured within a lock housing with one or more locking components;

an electronically operated locking mechanism that is coupled to the one or more locking components and configured to move the one or more locking components between a locked position in which the locking member is secured within the lock housing and an unlocked position in which the locking member is released from the lock housing; and a mechanically operated locking mechanism comprising a key cylinder that is coupled to the one or more locking components, wherein rotation of the key cylinder moves the one or more locking components between the locked position and unlocked position, such that movement of the one or more locking components by rotation of the key cylinder occurs independently of the electronically operating locking mechanism without requiring energization of the electromechanical actuator;

wherein said electronically operated locking mechanism includes a non-volatile memory source capable of storing two or more unlock codes.

20. The lock of claim 19 further comprising a button that can be selectively pressed to add or delete unlock codes from said non-volatile memory.

21. The lock of claim 20, wherein said button can only be pressed when said lock is in an unlocked position.

22. The lock of claim 19 wherein said one or more locking components comprises one or more locking levers.

23. The lock of claim 22, wherein said electronically operated locking mechanism and said mechanically operated locking mechanism operate independent of one another to move said one or more locking levers to said unlocked position.

24. The lock of claim 19, wherein said electronically operated locking mechanism includes a mechanism for receiving a coded message to unlock the lock from a remote signal generation source.

25. The lock of claim 19 further comprising an alarm system that can be selectively armed, and wherein said alarm system produces an alarm signal when a motion detection mechanism detects a motion event when said alarm system is armed.

26. A lock comprising:

a locking member that is selectively secured within a lock housing;

one or more locking levers that are selectively moved between two positions:

a locked position, wherein said locking member is secured within said lock housing; and an unlocked position, wherein said locking member is released and can be removed from said lock housing;

an electronically operated locking mechanism including a non-volatile memory source capable of storing two or more unlock codes;

a reset button housed within the lock housing and accessible through a reset opening in the lock housing that can be selectively pressed to add or delete unlock codes from said non-volatile memory; and a mechanically operated locking mechanism;

wherein said electronically operated locking mechanism and said mechanically operated locking mechanism operate independent of one another to move said one or more locking levers to said unlocked position, such that movement of the one or more locking levers by the mechanically operated locking mechanism occurs independently of the electronically operated locking mechanism without requiring energization of the electromechanical actuator;

wherein at least one of said one or more locking levers is positioned between the reset button and the reset opening when the one or more locking levers are in the locked position and blocks access to the reset button such that said reset button can only be pressed when said one or more locking levers are in the unlocked position.

27. The lock of claim 26 further comprising an alarm system that can be selectively armed, and wherein said alarm system produces an alarm signal when a motion detection mechanism detects a motion event when said alarm system is armed.

28. The lock of claim 26, wherein said electronically operated locking mechanism includes a mechanism for receive a coded message to unlock the lock from a remote signal generation source.

29. A lock system comprising:

(i) a lock comprising:

(a) a locking member that is selectively secured within a lock housing;

(b) one or more locking levers that are selectively moved between two positions:

(1) a locked position, wherein said locking member is secured within said lock housing; and (2) an unlocked position, wherein said locking member is released and can be removed from said lock housing;

(c) an electronically operated locking mechanism that controls an electromechanical actuator that is coupled to the one or more locking levers, the actuator being configured to move the one or more locking levers between the locked position and the unlocked position; and (d) a mechanically operated locking mechanism comprising a key cylinder that is coupled to the one or more locking components, wherein rotation of the key cylinder moves the one or more locking components between the locked position and unlocked position;

wherein said electronically operated locking mechanism and said mechanically operated locking mechanism operate independent of one another to move said one or more locking levers to said unlocked position, such that movement of the one or more locking components by rotation of the key cylinder occurs independently of the electromechanical actuator without requiring energization of the electromechanical actuator; and (ii) a device for transmitting an unlock code to said electronically operated lock mechanism.

30. The lock system of claim 29, wherein said device for transmitting an unlock code to said lock is a key fob.

31. The lock system of claim 29, wherein said lock further comprises a mechanism for receiving said unlock code.

32. The lock system of claim 31 further comprising a non-volatile memory source capable of storing two or more unlock codes.

33. The lock of claim 31 further comprising a button that can be selectively pressed to add or delete unlock codes from said non-volatile memory.

34. The lock of claim 33, wherein said button can only be pressed when said lock is in an unlocked position.

35. A lock comprising:

(a) a shackle that is selectively secured within a lock housing;

(b) one or more locking levers that are selectively moved between two positions:

(i) a locked position, wherein said shackle is secured within said lock housing; and (ii) an unlocked position, wherein said shackle is released and can be removed from said lock housing;

(c) an electronically operated locking mechanism comprising:

(i) an IR detector for receiving coded unlock messages from a remote IR signal generation source; and (ii) a motor, at least two spur gears, at least one drive shaft, at least two worm gears, and a cam shaft, wherein said cam shaft includes one or more protrusions that interact with a portion on said one or more locking levers to move the locking levers to said unlocked position when said cam shaft is rotated;

(d) a mechanically operated locking mechanism comprising:

(i) a lock cylinder; and (ii) a cylinder extension coupled to said lock cylinder, wherein said cylinder extension includes a flange that interacts to a portion of said one or more locking levers to move the locking members to the unlocked position when said cylinder extension is rotated; and wherein said electronically operated locking mechanism and said mechanically operated locking mechanism operate independent of one another to move said one or more locking levers to said unlocked position.

* * * * *